US008939082B2

(12) United States Patent
Liebenberg

(10) Patent No.: US 8,939,082 B2
(45) Date of Patent: Jan. 27, 2015

(54) BLASTING ARRANGEMENT

(75) Inventor: Abraham Johannes Liebenberg, Kempton Park (ZA)

(73) Assignee: Detnet South Africa (Pty) Ltd, Sandton (ZA)

( * ) Notice: Subject to any disclaimer, the term of this patent is extended or adjusted under 35 U.S.C. 154(b) by 0 days.

(21) Appl. No.: 13/822,248

(22) PCT Filed: Jul. 7, 2011

(86) PCT No.: PCT/ZA2011/000044

§ 371 (c)(1),
(2), (4) Date: Mar. 28, 2013

(87) PCT Pub. No.: WO2012/034137

PCT Pub. Date: Mar. 15, 2012

(65) Prior Publication Data

US 2013/0180422 A1 Jul. 18, 2013

(30) Foreign Application Priority Data

Sep. 9, 2010 (ZA) ..... 2010/06452

(51) Int. Cl.
*F42D 1/05* (2006.01)
*F42D 5/00* (2006.01)

(52) U.S. Cl.
CPC ... *F42D 1/05* (2013.01); *F42D 5/00* (2013.01)
USPC ..... 102/217; 102/206; 102/301; 102/311; 361/248

(58) Field of Classification Search
USPC ..... 102/301, 302, 311, 312, 200, 206, 215, 102/217, 218, 202.1, 202.3; 361/247, 248, 361/249, 250, 251
See application file for complete search history.

(56) References Cited

U.S. PATENT DOCUMENTS

| | | | | |
|---|---|---|---|---|
| 3,750,586 | A | 8/1973 | Swallow et al. | |
| 3,934,514 | A * | 1/1976 | Dawkins | 102/217 |
| 4,124,835 | A | 11/1978 | Cahill, Jr. | |
| 4,846,066 | A | 7/1989 | Beattie et al. | |
| 5,936,508 | A | 8/1999 | Parker | |
| 6,373,370 | B1 | 4/2002 | Darr et al. | |
| 6,456,189 | B1 | 9/2002 | Mosesian | |
| 6,480,091 | B1 | 11/2002 | Scott et al. | |
| 6,809,627 | B2 | 10/2004 | Castonguay, Jr. | |
| 7,307,507 | B2 | 12/2007 | Darr et al. | |
| 7,694,627 | B2 | 4/2010 | Koekemoer et al. | |
| 7,724,122 | B2 | 5/2010 | Leach | |

(Continued)

FOREIGN PATENT DOCUMENTS

| | | |
|---|---|---|
| AU | 2008202993 | 1/2010 |
| CA | 2200891 | 9/1998 |

(Continued)

OTHER PUBLICATIONS

PCT/ZA2009/000082 International Search Report and Written Opinion dated May 31, 2010 (8 pages).

(Continued)

*Primary Examiner* — James S Bergin
(74) *Attorney, Agent, or Firm* — Michael Best & Friedrich LLP

(57) ABSTRACT

For use in a blasting system (10), a visible, throw-away, safety lockout device (30) which operates automatically, to interrupt power to the blasting system (10), upon the occurrence of one or more defined fault conditions.

10 Claims, 1 Drawing Sheet

(56) References Cited

U.S. PATENT DOCUMENTS

| | | | | |
|---|---|---|---|---|
| 7,911,760 | B2 | 3/2011 | Lownds | |
| 7,946,227 | B2 | 5/2011 | Koekemoer et al. | |
| 8,646,387 | B2 * | 2/2014 | Schlenter | 102/217 |
| 8,695,505 | B2 * | 4/2014 | Koekemoer et al. | 102/206 |
| 2003/0107322 | A1 | 6/2003 | Melvin et al. | |
| 2012/0167792 | A1 | 7/2012 | Schlenter | |

FOREIGN PATENT DOCUMENTS

| | | |
|---|---|---|
| EP | 2065542 | 6/2009 |
| EP | 2243903 | 10/2010 |
| NL | 1027161 | 4/2006 |
| WO | 2005/045353 | 5/2005 |
| WO | 2006/094358 | 9/2006 |
| WO | 2007/124517 | 11/2007 |
| WO | 2011/032189 | 3/2011 |
| WO | 2012/034137 | 3/2012 |

OTHER PUBLICATIONS

PCT/ZA2009/000082 International Preliminary Report on Patentability dated Dec. 23, 2011 (16 pages).

PCT/ZA2011/000044 International Search Report and Written Opinion dated Nov. 21, 2011 (8 pages).

PCT/ZA2011/000044 International Preliminary Report on Patentability dated Oct. 23, 2012 (17 pages).

Co-pending U.S. Appl. No. 13/395,375, filed Mar. 9, 2012.

* cited by examiner

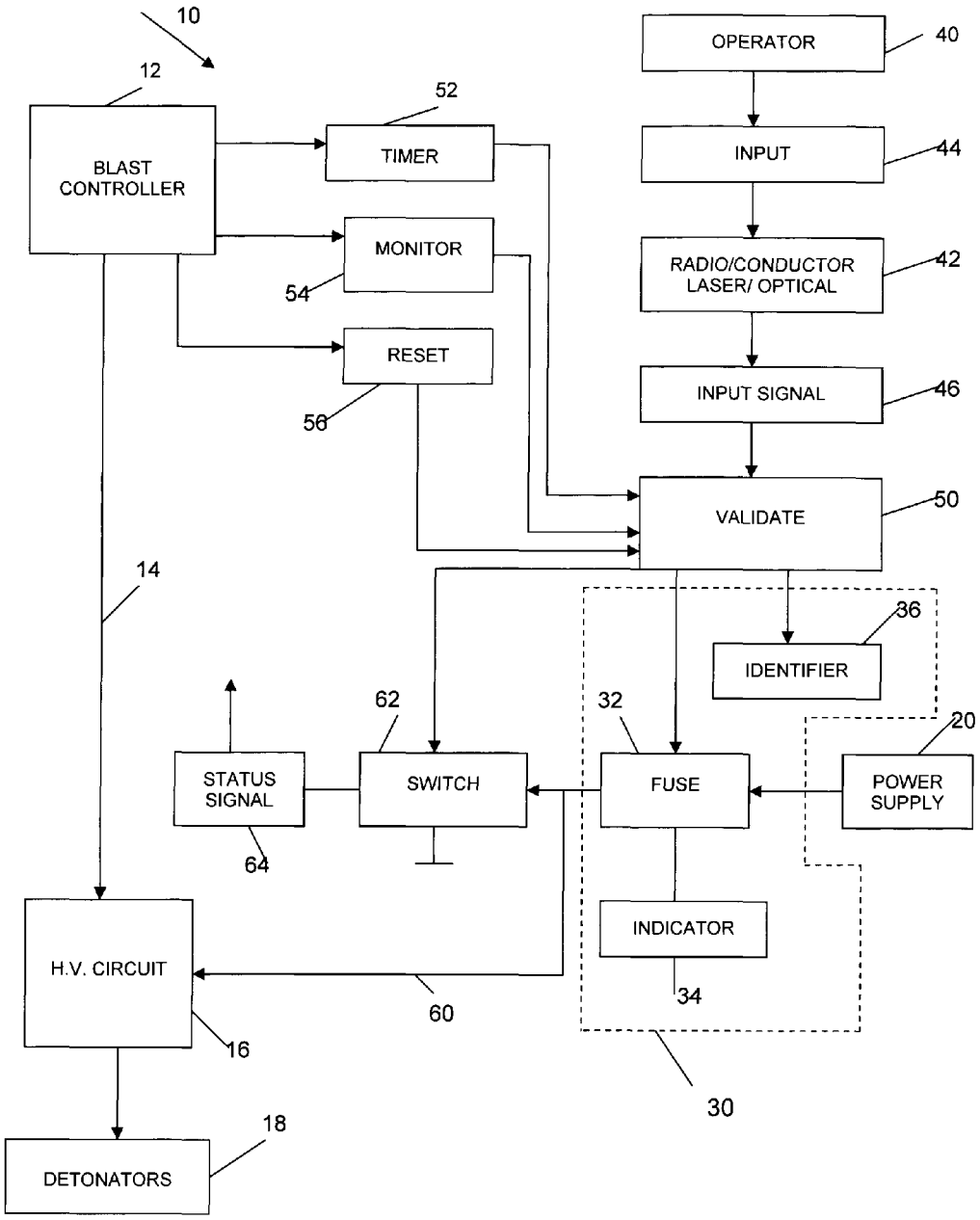
10
12
BLAST CONTROLLER
52
TIMER
MONITOR
54
RESET
56
OPERATOR
40
INPUT
44
RADIO/CONDUCTOR LASER/ OPTICAL
42
INPUT SIGNAL
46
VALIDATE
50
14
36
IDENTIFIER
62
32
20
STATUS SIGNAL
SWITCH
FUSE
POWER SUPPLY
64
INDICATOR
H.V. CIRCUIT
60
34
16
30
18
DETONATORS

BLASTING ARRANGEMENT

BACKGROUND OF THE INVENTION

This invention relates to a blasting arrangement.

A typical blasting system consists of a blast controller connected to a plurality of detonators by means of an appropriate harness. Once the detonators have been positioned inside boreholes prescribed procedures are carried out by an operator to ensure that the blasting system is fully functional.

Great care is taken when a blasting system is established. Nonetheless a malfunction can occur and, when this happens, it is vital to be able to render the blasting system safe i.e. to place the system in a condition in which the detonators cannot be initiated or fired. For example an operator who detects a potentially unsafe condition should be able to neutralize the blasting system particularly if the system has already been readied for firing. In this type of situation it is highly desirable for the operator to be given a clear signal that the blasting system has been put into a safe mode. The operator will then in confidence be able to approach the detonators and take suitable remedial action.

Many devices have been proposed for use in blasting systems and in other electrically-based arrangements wherein use is made of a fuse which provides a vital connection between a power source and detonators or other equipment. If an unsafe or unwanted condition is detected the fuse is open-circuited to render the arrangement safe and, at the same time, an indication is given of the conducting state of the fuse. The specifications of U.S. Pat. Nos. 5,936,508, 6,373,370, 6,456,189, 6,480,091, 6,809,627, 7,307,507 and 7,724,122 describe various kinds of fuses which provide a visual indication of a fuse-interrupted condition. This type of fuse is generally suited for use in a relatively confined situation in which the non-conducting status of the fuse is readily visually discernable. Also, the fuse is normally placed in a non-conductive state by virtue of a malfunction or unwanted condition arising in the equipment to which the fuse is connected. These characteristics mean that this type of indicating fuse is not well-suited for use in a blasting operation in which it is important, at least from a safety point of view, to have a substantial distance between an operator and a number of detonators and, despite the distance, for the operator being able to ascertain whether or not the blasting system is in a safe or unsafe mode. Additionally, as this type of indicating fuse is usually operable only in response to a malfunction or unwanted condition in the equipment to which the fuse is connected, it cannot normally be put into a non-conducting state by an operator.

Another approach to the requirement of providing a visual indication of an unsafe condition, in a blasting system, is described in the specification of PCT/ZA 2004/000130 wherein use is made of a link in a connection to a blasting system. The link is displaceable to a position at which the connection is automatically broken, thereby to render the blasting system safe, when an unsafe condition arises. The displacement of the link is done in a way which is visually apparent to an operator. Although in many respects the operation of this type of indicator, also referred to a mechanical flag, is satisfactory it has been found that, particularly in harsh environments, failures in operation can occur. The mechanical flag can be reset by an operator when required and although this feature does have some advantages it carries with it the inherent disadvantage that, through repeated use, the indicating system may become faulty.

U.S. Pat. No. 3,750,586 discloses a blasting arrangement which includes an energy source, at least one detonator, a blast controller, a circuit which establishes a connection between the energies force and the detonator and which, in response to a signal from a blast controller, allows energy from the energy source to initiate the detonator. The blasting arrangement further includes a device which in response to at least one actuating signal is operable to break the connection thereby preventing initiation of the detonator and to produce a discernible indication of its operation. This disclosure does not describe a way in which the device, upon operation, is rendered non-usable. This is desirable for safety reasons.

An object of the present invention is to provide a blasting arrangement which enables an operator, in a condition of relative safety, to establish the status of the blasting arrangement.

SUMMARY OF INVENTION

The invention provides a blasting arrangement which includes an energy source, at least one detonator, a blast controller, a circuit which establishes a connection between the energy source and the detonator and which, in response to a signal from the blast controller, allows energy from the energy source to initiate the detonator, and a device which, in response to at least one actuating signal, is operable:

(a) to break the connection, thereby preventing initiation of the detonator; and (b) to produce a discernable indication, of its operation wherein the device includes a fuse which is open-circuited to render the device non-usable, upon operation of the device.

The detonator may be one of a plurality of detonators connected in any appropriate way to the blast controller, for example through the use of an appropriate harness.

The energy source may have a maximum voltage at a first voltage level and the detonator may have a safe no-fire voltage at a second voltage level which is greater than the first voltage level. This means that without the intervention of the circuit it is not possible for the energy source to initiate the detonator.

The circuit may be operable to produce an operating voltage, used for initiation of the detonator, at a third voltage which is greater than the second voltage.

The device may be operable to break the connection at a location which is between the energy source and the circuit, or at a location which is between the circuit and the detonator, or at both locations.

The device, upon operation, is rendered non-reusable. The device may for example be destroyed or at least part of the device may be destroyed.

The actuating signal may be originated at a point which is displaced from the device. The actuating signal may be produced by intervention of an operator. The actuating signal may be transferred to the device via an appropriate communication link. For example use may be made of a radio link, an optical fibre link, an electrical conductor (wire or cable) or an optical signal which is transmitted by laser, or any equivalent signal. The invention is not limited in this respect.

The indication which is produced by the device may be of any appropriate kind. The indication may be a noise or acoustic (audible) signal. The indication may be a visual signal e.g. a smoke signal, a change in colour of the device or of a component associated with or responsive to the device. It is also possible for the indication to be the absence or presence of the device or a component associated with the device.

In one form of the invention the fuse in the device is exposed to an appropriate chemical composition and, when the fuse is open-circuited (fused), the chemical composition is caused to generate a visible signal, to change colour or emit smoke. The chemical composition may be housed, at least partly, inside a transparent container so that, for example, if smoke is generated by the composition upon open-circuiting of the fuse the smoke is contained inside an enclosure. This enhances the visibility, and the duration of the visibility, of the indication.

In a different form of the invention the fuse is exposed to a carrier e.g. a card which carries a chemical composition. When the fuse is open-circuited the carrier is consumed by fire or otherwise is destroyed or caused to change shape or colour by the interaction of suitable chemical compounds. The invention is not limited in this respect.

The device or a part thereof may be releasably engaged with supporting structure. The supporting structure may contain the circuit or the energy source or both.

The device may be uniquely configured so that only the device, or a device which is in all material respects identical to the device, is engageable with the structure. For example the device may include a unique arrangement of connecting pins or formations which are engageable with complementary pockets or formations on the structure. This physical approach prevents a device which is not authorized for use in the blasting arrangement from being used to enable the circuit. In a different approach the device includes an identifier which must be validated to enable the device to be used with the circuit. For example the device may include a code which is unique to the device or a code which relates to a class in which the device is included.

Other characteristics of the device may be used for validation purposes. The device may for example include an electrical component e.g. a resistor the value of which must be confirmed if the device is to be usable together with the circuit. These techniques enable a substantial degree of control to be exercised over the use of the blasting arrangement.

The actuating signal may be initiated by an operator. This facility allows the operator to place the blasting arrangement in a safe condition, when required, and when this occurs the indication which is produced is discernable by the operator from a remote distance which, under the conditions, is regarded as a safe distance i.e. as used herein, "externally discernable".

Other actuating signals can be used to break the connection. For example if the blasting system is armed and a firing signal is not produced within a predetermined time interval then an actuating signal may automatically be produced by the blast controller to place the system in a safe mode i.e. to operate the device and thereby break the connection and to produce the externally discernable indication. A similar situation may ensue if a monitoring circuit associated with the blast controller detects an unsafe or unwanted condition in the blasting system. It is also desirable to produce an actuating signal which automatically functions in the aforementioned manner when blasting has taken place i.e. the detonator or detonators have been fired. In each instance an indication is given to an operator that the blasting arrangement has been placed into a safe condition.

BRIEF DESCRIPTION OF THE DRAWING

The invention is further described by way of example with reference to the accompanying drawing which is a block diagram representation of aspects of a blasting arrangement according to the invention.

DESCRIPTION OF PREFERRED EMBODIMENT

The accompanying drawing illustrates, in block diagram form, aspects of a blasting arrangement 10 according to the invention.

The blasting arrangement includes a blast controller 12 which is connected via a harness 14 to a high voltage circuit 16 which, in turn, is connected to a plurality of detonators 18 placed in respective boreholes, not shown.

A suitable battery 20 is used to power the blasting arrangement. The detonators have a safe no-fire voltage or culling voltage of the order of 12.5 volts. The battery, which may be rechargeable, has a maximum voltage which is at least 2 volts lower than the safe no-fire voltage e.g. of the order of 10 volts. It is therefore not possible for the battery to fire any of the detonators directly. The function of the high voltage circuit 16 is to increase the voltage which is available from the battery, under controlled conditions, to enable charging and blasting of the detonators.

A control and indicating device 30 is connected between the battery 20 and the high voltage circuit 16. The device 30 includes a fuse 32, an indicating arrangement 34 and, optionally, an identifier 36. An operator 40 can communicate with the device 30 via a suitable communications link 42 which may be radio based, or comprise an optical signal, a laser signal or a conductive lead or wire. The operator, via an input mechanism 44 e.g. a keyboard, can produce a signal 46 which is input to the device through a validation module 50.

The blast controller includes, or otherwise controls the operation of, a timer unit 52, a monitor unit 54 and a reset unit 56. These units are also connected to the validation module 50.

Power to the high voltage circuit 16 passes from the battery 20 through the fuse 32 and then through a line 60. A switch 62 is connected to the line. Upon operation, the switch is capable of generating a status signal 64.

Assume that a blasting sequence has been commenced and that the operator 40 detects a situation which is unwanted. The operator can then produce the input signal 46 which is directed to the module 50. The signal is validated in accordance with preset criteria and, when this occurs, an output signal is produced by the module which causes operation of the switch 62. The fuse is then directly connected to ground via a low-resistance path. A substantial current flows from the battery 20 through the fuse to ground and, in the process, the fuse is open-circuited (fused).

The switch may be of any suitable kind and for example may comprise a relay, a semiconductor switch or the like. The invention is not limited in this respect.

When the fuse is open-circuited (fused) the indicator 34 is actuated. The indicator may be adapted to give an audible or visual signal of any suitable kind which is discernable from a safe distance by the operator ("externally discernable"). For example the fuse may be exposed to a chemical which produces a gas, such as smoke, which is brightly coloured. A dotted line around the device 30 indicates that the fuse and the indicator may be contained inside a housing, for example an enclosure which is at least partly transparent and which is filled with a visible gas, e.g. smoke, when the fuse is open-circuited.

When the switch 62 is closed the status signal 64 is transmitted to the blast controller to notify the controller of the state of the blasting arrangement.

A similar process can take place due to a variety of factors. For example if a blasting sequence is commenced and a firing signal is not sent to the detonators within a predetermined period then this is detected by the timer unit 52 and a signal is transmitted to the validation module 50. Upon validation the switch 62 is closed and the fuse is open-circuited (fused). The monitoring unit 54 is used to detect any unsafe condition or potentially unsafe condition in the blasting arrangement and, similarly, if this type of condition is detected, the fuse is open-circuited. Also, if blasting does in fact take place then a signal is automatically generated by the blast controller 12 via the reset unit 56 and the fuse is, again, open-circuited by being connected to ground.

The device 30 optionally includes the identifier 36. The purpose of the identifier is to ensure that particular blasting equipment is only usable under defined conditions. For example the device 30 may have a unique set of contacts or formations which are engageable only with complementary formations on a defined blast controller or equipment associated with the blast controller thereby to establish the connection between the fuse and the switch. The device 30 enables a blasting arrangement to be set up and a blasting operation to be carried out. Consequently, unless the device 30 is of a defined type, it is not possible for blasting to take place. As the fuse 32 is destroyed by an actuating signal originating from an operator, or from any of the units 52 to 56, a fresh device must be employed if the blasting arrangement is to be established.

The identifier 36 may alternatively or additionally include another mechanism. For example the identifier may be a password or a firing code or a group identifier which relates to the detonators or to the blast controller or to any other aspect which is uniquely associated with a particular situation. Identifiers may be used to designate the types of detonators with which the device 30 is to be used. The identifier may also be tied to a physical location or relate to a time and date on which the blasting arrangement is to be implemented.

The fuse 32, when open-circuited, interrupts the supply of power to the high voltage circuit. In a different arrangement the fuse is positioned between the high voltage circuit and the detonators and, when open-circuited, interrupts a connection between the circuit 16 and the detonators.

The device 30 thus comprises a visible, throw-away, safety lockout mechanism to furnish the operator with a physical means for disabling the blast voltage generating circuit 16, or for disconnecting the circuit 16 from the detonators. The device has no moving parts or active components and is more robust than a mechanical flag or a lockout device which may be prone to failure in harsh environments. The device 30 can be actuable automatically under certain defined conditions, or by means of an operator when circumstances dictate that corrective action should be taken.

The invention claimed is:

1. A blasting arrangement (10) which includes an energy source (20), at least one detonator (18), a blast controller (12), a circuit (16) which establishes a connection between the energy source (20) and the detonator (18) and which, in response to a signal from the blast controller (12), allows energy from the energy source (20) to initiate the detonator (18), and a device (30) which, in response to at least one actuating signal, is operable:

(a) to break the connection, thereby preventing initiation of the detonator (18); and (b) to produce a discernable indication, of its operation, characterised in that the device (30) includes a fuse (32) and in that the device (30) upon operation, is rendered non-usable by open-circuiting the fuse (32).

2. A blasting arrangement according to claim 1 wherein the energy source (20) has a maximum voltage at a first voltage level and the detonator (18) has a safe no-fire voltage at a second voltage level which is greater than the first voltage level, and wherein the circuit (16) is operable to produce an operating voltage, used for initiation of the detonator (18), at a third voltage which is greater than the second voltage.

3. A blasting arrangement according to claim 1 wherein the device (30) is operable to break the connection at a location which is between the energy source (20) and the circuit (16), or at a location which is between the circuit (16) and the detonator (18), or at both locations.

4. A blasting arrangement according to claim 1 wherein the actuating signal is produced by intervention of an operator at a point which is displaced from the device and is transferred to the device (30) via a communication link (42).

5. A blasting arrangement according to claim 1 wherein the discernable indication is at least one of the following: a visual signal; an audible signal.

6. A blasting arrangement according to claim 1 wherein the device (30) includes a housing, and an indicator (34) which is inside the housing, and the fuse (32) which, in use, is connected between a power supply (20) and the detonator (18), and wherein the indicator is operable to produce an indication, externally discernable by an operator, upon the occurrence of at least one of the following:

if the fuse (32) is open-circuited;

if the blasting arrangement is armed and a firing signal is not produced within a predetermined time interval;

upon detection of an unsafe or unwanted condition in the blasting arrangement;

upon firing of the detonator (18);

if the blasting arrangement has been placed in a safe condition; and upon initiation of an actuating signal by an operator.

7. A blasting arrangement according to claim 6 wherein the housing is at least partly transparent and wherein said indication comprises the production of a visible gas.

8. A blasting arrangement according to claim 6 wherein the device (30) includes an identifier (36) which restricts use of the device to defined equipment included in the blasting arrangement.

9. A blasting arrangement according to claim 8 wherein the identifier (36) includes at least one of the following:

a unique set of formations which are engageable only with complementary formations on the defined equipment, and a code which is uniquely related to at least one parameter.

10. A blasting arrangement according to claim 9, wherein the at least one parameter includes at least one of the following:

the blasting arrangement, a location at which the blasting equipment is to be used, and a date on which the blasting arrangement is to be used.

* * * * *